US005487237A

United States Patent [19]

Martin, Jr.

[11] Patent Number: 5,487,237

[45] Date of Patent: Jan. 30, 1996

[54] SECURITY DEVICE FOR BUILDINGS

[76] Inventor: Bill Martin, Jr., 704 S. 400 West, Salt Lake City, Utah 84101

[21] Appl. No.: 284,390

[22] Filed: Aug. 2, 1994

[51] Int. Cl.[6] ..... E06B 3/68

[52] U.S. Cl. ..... 49/57; 49/395; 49/465

[58] Field of Search ..... 49/57, 50, 61, 49/55, 394, 395, 465

[56] References Cited

U.S. PATENT DOCUMENTS

| | | | |
|---|---|---|---|
| 936,041 | 10/1909 | Rush | 49/57 X |
| 980,535 | 1/1911 | Kleinegger | 49/57 |
| 1,550,404 | 8/1925 | Vincent | 49/57 |
| 1,902,949 | 3/1933 | Condon | 49/57 |
| 4,059,923 | 11/1977 | Sauer | 49/57 |
| 4,283,881 | 8/1981 | Moore et al. | 49/57 X |
| 4,461,119 | 7/1984 | Smith | 49/465 X |
| 4,848,030 | 7/1989 | Bennett | 49/57 |

FOREIGN PATENT DOCUMENTS

| | | | |
|---|---|---|---|
| 3412608 | 10/1985 | Germany | 49/57 |

OTHER PUBLICATIONS

Advertisement–model 2500 Egressable Multi–Point Lock Single Point Release, Blackhawk Architectural Products.

Advertisement–Emergency Release, Texas Metal Industries, Inc.

Advertisement–Emergency Release, Lock System for Window Guards.

Advertisement–Kwikset Locksets, p. 10.

Advertisement–Thinline Lock & Pre–Punched Steel Tubing. p. 9.

Advertisement–Emergency Release, p. 9.

Advertisement–Weldable Gate Lock, p. 9.

*Primary Examiner*—Philip C. Kannan

*Attorney, Agent, or Firm*—Thorpe, North & Western

[57] ABSTRACT

A security device for buildings comprises a barricade including a metal frame with a metal gridwork anchored thereto and extending across and covering the interior frame opening. The frame is configured to fit within a doorway or window opening. At least one positioning bar is disposed on one side of the frame and extends outward therefrom to beyond the frame perimeter, said positioning bar configured for placing into a receiving slot formed in the interior perimeter of the doorway or window opening. A locking bar is slidably journalled within guide track openings formed in guide tabs which are secured to the barricade. Said locking bar includes at least one perimeter locking end for slidable entry into a receiving slot formed in the interior perimeter of the doorway or window opening. Opposite said perimeter locking end on the locking bar is an interior locking end which releasably interlocks with the mounting plate when the perimeter locking end is seated within said receiving slot to thereby retain the barricade in a secured position.

14 Claims, 4 Drawing Sheets

SECURITY DEVICE FOR BUILDINGS

BACKGROUND OF THE INVENTION

1. The Field of the Invention

The present invention relates generally to security devices. More particularly, it concerns a portable, reusable device for releasably blocking the openings of a building, such as a window opening or doorway.

2. The Background Art

A number of devices and methods for blocking doorways and window openings are known in the art. For example, most doorways are closed off by doors having a lockable doorknob operable with a key, a bolt and chain device, a latch device lockable with a padlock, or some other device which allows the door to be releasably secured within the doorway when desired. Some windows are permanently secured within a window opening, while others are releasably secured therein. While most doors, windows and the like can be locked, unlocked, opened and closed, they are usually permanently affixed by hinges or guide tracks and often can be unlocked from both the inside and the outside of the building. Conversely, window grills and the like are often installed for security purposes and are usually bolted in place and thus cannot be opened or removed without tools. Of current interest are portable, nonpermanent apparatus for blocking openings in buildings which are releasable from one side only.

It is sometimes the case that buildings go uninhabited for a period of time for various reasons. The relocation or eviction of tenants, significant building maintenance or rehabilitation, and condemnation of the building are a few such reasons. In such cases, the owner of the building or some other authorized party often desires to prevent vandals, squatters, drug dealers and other unauthorized parties from entering or occupying the building. However, doors and windows sometimes become damaged and unlockable. Even when all doors and windows of a building remain intact during uninhabitation, they are seldom adequate protection against unauthorized entry or occupation.

Conventional approaches to solving these problems include nailing or bolting plywood and the like over the windows and doors. However, this approach is ineffective against any unauthorized party equipped with a crowbar, saw, hammer or even a stone. Even in those cases where a plywood is successful in preventing unauthorized entry, the numerous nail and bolt holes required to secure the plywood deface the building. Moreover, this and other similar approaches are very time consuming in terms of installation and removal and are quite expensive in that plywood weathers and is therefore seldom reusable.

Window bars and window grills have been developed and are much more effective than plywood or simple wire in preventing unwanted entry to uninhabited buildings. Some window bar devices are simply bolted over the opening, while others are hinged at one end and are selectively lockable at an opposing end from both the inside and outside of the building. However, such devices still require bolts or nails and thus do not solve the problems of building defacement or time consumption.

There is thus a need to achieve a durable device for blocking window and door openings in uninhabited buildings which is quick and easy to use, portable, reusable, strong enough to prevent unauthorized entry, and which minimizes or eliminates any necessary defacement to the building. Those having ordinary skill in the art will appreciate that these and other needs are met by the present invention.

The disadvantages of the prior art noted above, and others not specifically mentioned, are overcome in the present invention by provision of a security device having a self contained locking means.

OBJECTS AND SUMMARY OF THE INVENTION

It is therefore an object of the present invention to provide a security device for blocking openings to a building which is quick and easy to use.

It is an additional object of the invention to provide such a security device which is portable and nonpermanently lockable to an opening of a building.

It is another object of the invention to provide such a security device which significantly minimizes any defacement to a building required for installation of said device.

It is also an object of the invention to provide such a security device which is strong, durable and effective against unauthorized entry of a building.

It is still another object of the invention to provide such a security device which is reusable over and over again.

While the present invention is described in terms of a security barricade to be used for blocking window openings and doorways in buildings, it is to be understood that the principles of the invention may be used in any setting requiring the blocking of openings in structures. Those having ordinary skill in the field of this invention will appreciate the advantages of the invention, and its application to a wide variety of uses.

The above objects and others not specifically recited are realized in a first illustrative embodiment of a metal security barricade for blocking openings to a building. The security barricade includes a sturdy metal frame and a metal gridwork anchored thereto and extending across and covering the interior frame opening. The interior frame opening is bounded on at least two opposing sides by first and second frame members. The frame is configured to fit within an opening of a building such as a door way or window opening, preferably such that its perimeter edges are either contiguous with or very close to the interior perimeter of said opening. At least one positioning bar is disposed on the second frame member and extends outward therefrom and beyond the frame perimeter. Said positioning bar is configured for slidable entry into a receiving slot formed in the interior perimeter of the window or door opening. A locking bolt is releasably screwed into a threaded slot formed within the first frame member. A perimeter locking end of said bolt extends outward from and beyond said first frame member into a receiving slot formed in the interior perimeter of the window or door opening adjacent thereto to thereby retain the barricade in a secured position.

In a second embodiment, at least one mounting plate is coupled to the frame and the gridwork. At least two guide tabs having substantially collinear guide track openings are securely attached to the barricade, one to the mounting plate and the other to the first frame member. A sturdy metal locking bar is slidably journalled within the guide tabs. Said locking bar includes at least one perimeter locking end for placing into a receiving slot formed in the interior perimeter of the window or door opening. Opposite said perimeter locking end on the locking bar is an interior locking end which releasably interlocks with the mounting plate when the perimeter locking end is seated within said receiving slot to thereby retain the barricade in a secured position.

In use of the first illustrative embodiment, a user slides the barricade into a doorway or window opening at a slight angle so that the second frame member approaches one side of the opening, until the positioning bar slides into a receiving slot formed in said one side of the opening. The user then swivels the barricade completely into the opening and insert the locking bolt into the threaded slot so that its perimeter end is received into a receiving slot formed in the interior perimeter of the opening, preferably in a side of the opening either opposite or perpendicular to said one side of the opening. The user then releasably screws the locking bolt into the threaded slot to thereby retain the barricade in a secured position.

BRIEF DESCRIPTION OF THE DRAWINGS

The above and other objects, features and advantages of the invention will become apparent from a consideration of the subsequent detailed description presented in connection with the accompanying drawings in which.

Figure 1:
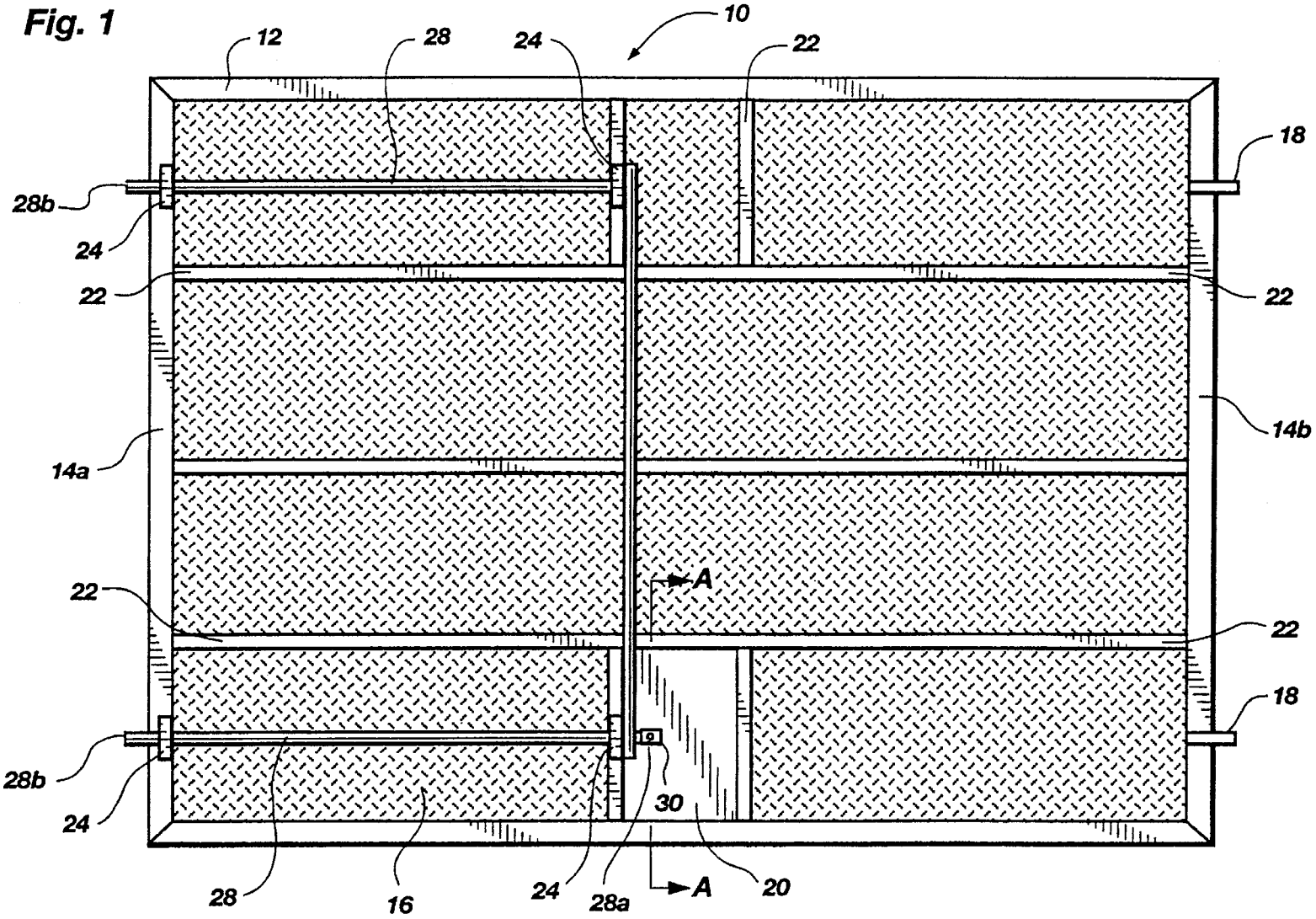
FIG. 1 is a front view of a security barricade made in accordance with the principles of the present invention.

DETAILED DESCRIPTION OF THE PRESENTLY PREFERRED EMBODIMENTS OF THE PRESENT INVENTION

Reference will now be made to the drawings wherein like structures will be provided with like reference numerals.

Figure 2:
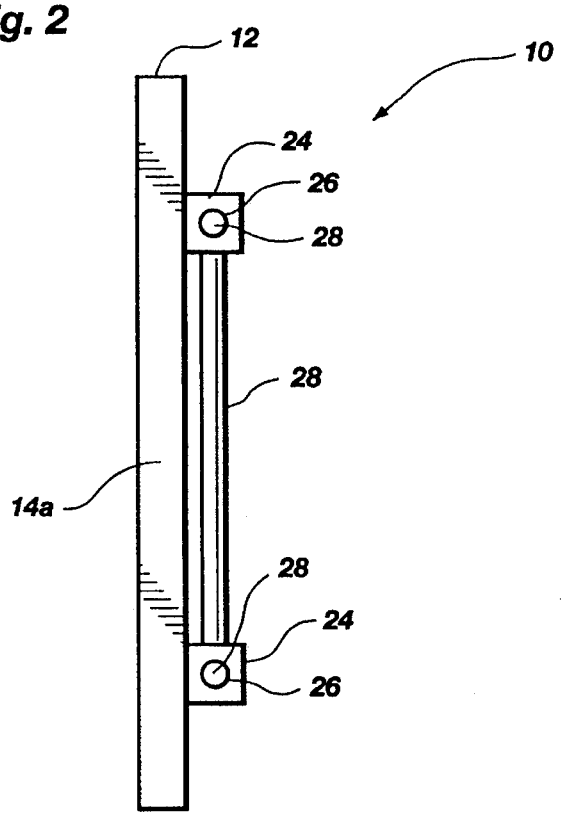
FIG. 2 is a side view of the security barricade of FIG. 1.

Referring to FIGS. 1–2, there is shown a security barricade, generally designated at 10, for placement within a doorway or window opening of a building structure. The barricade 10 includes a sturdy metal frame 12 defining an interior frame opening bounded on at least two opposing sides by first and second opposing frame members 14*a* and 14*b*, respectively. A security grid 16 covers the interior opening of the frame 12 and is anchored to said frame. Positioning bars 18 are disposed on the second frame member 14*b* and extend outward therefrom and beyond the perimeter of the frame 12. A mounting plate 20 is coupled to the frame 12 and the grid 16. Reinforcing ribs 22 span the frame 12 and are anchored thereto. Guide tabs 24 having substantially collinear guide track openings 26 are securely attached to the mounting plate 20, the grid 16 and the first frame member 14*a*. A locking bar 28 is slidably journalled within the guide tabs 24 through the guide track openings 26. The locking bar 28 includes perimeter locking ends 28*b* and an opposing interior locking end 28*a*. The interior locking end 28*a* includes interlocking means 30.

Although the barricade 10 is characterized herein as comprising a frame 12 to which a security grid 16 and reinforcing ribs 22 are attached, it may alternatively comprise a single structural element made of metal, wood, composites or some other sturdy structural material. Moreover, the barricade 10 may comprise a frame 12 with a grid 16 but no reinforcing ribs 22, or a frame 12 with reinforcing ribs 22 but no grid 16. In other words, the barricade 10 may comprise any structural insert which is effective in restraining people from entering buildings.

A preferred embodiment is shown in FIGS. 1–2. The frame 12, grid 16 and reinforcing ribs 22 preferably comprise metal but may be made of other materials. The grid 16 preferably completely covers the interior frame opening of the frame 12, but may of course cover only a portion or portions thereof as desired. The positioning bars 18 are metal studs which are welded or otherwise secured to the second frame member 14*b* and are preferably perpendicular thereto. The positioning bars 18 may also extend within the interior frame opening and may thereby be secured to the ribs 22, the grid 16 or both. The mounting plate 20 is a metal plate welded or otherwise secured to the frame 12 and the grid 16. The guide tabs 24 are metal pieces welded or otherwise secured to the mounting plate 20, the first frame member 14*a*, and the grid 16. One or more of said guide tabs may alternatively be secured to any of said reinforcing ribs 22. The guide track openings are preferably collinear but may be arranged otherwise as dictated by the design of the locking bar 28.

The locking bar 28 is preferably a three-sided, square U-shaped member as shown in FIG. 1 in order to comprise the two perimeter locking ends 28*b* as shown. Said locking bar preferably comprises a single interior locking end 28*a* as shown but may comprise a plurality of interior locking ends. The interior locking end 28*a* is preferably square in cross section, but may of course comprise a round cross section or some other shape. Said locking bar may also comprise simply a single elongate rigid metal bar or rod having a single perimeter locking end and an opposing interior locking end.

Figure 3:
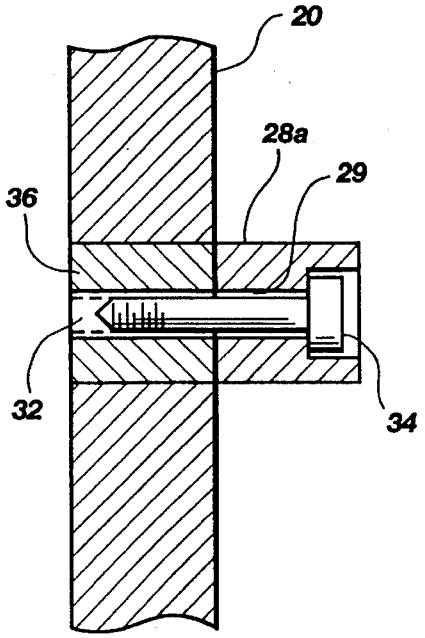
FIG. 3 is a side cross sectional view of the locking portion of the security barricade of FIG. 1 taken along section A—A.
Figure 4:
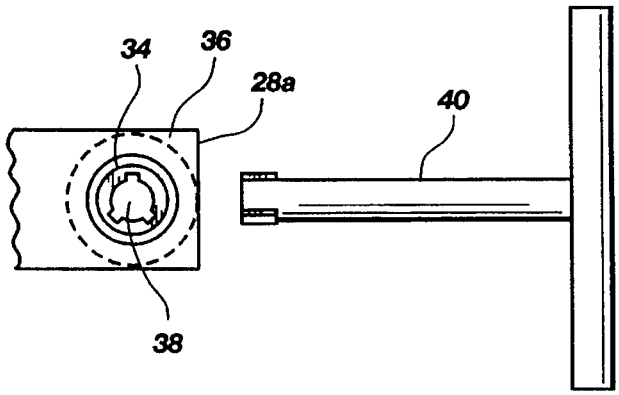
FIG. 4 is a front view of the locking portion of FIG. 3.

The interlocking means 30 is best illustrated in FIGS. 3–4. The interior locking end 28*a* of locking bar 28 comprises a locking slot 29, which may or may not be threaded. A threaded reinforcement insert 36 is welded or otherwise secured within the mounting plate 20 and comprises a threaded receiving slot 32. The locking bar 28 is slidably placed through the guide tabs 24 until the locking slot 29 of the interior locking end 23*a* communicates with said threaded receiving slot 32 of the mounting plate 20 as shown in FIG. 3. A locking bolt 34 passes through said locking slot 29 and screws into said receiving slot 32, said bolt including a customized slotted head 38 which is operable by a customized wrench 40 mated to said slotted head. The wrench 40 and corresponding slotted head 38 can be fabricated in any manner known in the art such that conventional wrenches, screwdrivers and other common tools are ineffective in turning the locking bolt 34 or otherwise operating the locking means 30. Many different designs for the wrench 40 and its corresponding slotted head 38 may be used. In this manner, only those in possession of the wrench 40 can unlock or otherwise operate the interlocking means 30.

The interlocking means 30 may alternatively comprise simply a threaded opening directly within the mounting plate 20 instead of a reinforcement insert 36. Said interlocking means 30 may also comprise simply a threaded opening within a solid barricade 10 which does not include any mounting plate 20 or reinforcement insert 36. The locking bolt 34 may also comprise any devices known in the art for securing a locking bar 28 which abuts a mounting plate 20.

The preferred embodiment described above may be fabricated in any manner known to those skilled in the relevant art. Any sturdy material, or a combination of materials, may be used to fabricate the separate parts of the invention.

A user slides the barricade 10 into a window or door opening (not shown) which said barricade is designed to fit. The locking bar 28 is slidably positioned such that the perimeter locking ends 28*b* do not extend beyond the outer perimeter of the frame 12. The barricade 10 enters the doorway or window opening with the second frame member 14*b* first, and the positioning bars 18 are placed into corresponding receiving slots formed in the interior perimeter of said door or window opening. The user then swings the barricade 10 completely into the opening such that it is perimetrically circumscribed by said opening. The user then simply grasps and slides the locking bar 28 until the locking slot 29 communicates with the receiving slot 32. At this point the perimeter locking ends 28*b* extend beyond the outer perimeter of the frame 12 and are received into corresponding receiving slots formed in the interior perimeter of the doorway or window opening. The locking slot 29 and the threaded receiving slot 32 are thus adjacently collinear relative to each other so that the locking bolt 34 can be placed through said locking slot and releasably screwed into said threaded receiving slot with the customized wrench 40 to thereby retain the barricade in a secured position.

The user is free to selectively remove or replace the barricade 10 at any time by simply unscrewing the locking bolt 34 with the customized wrench 40, sliding the perimeter locking ends 28*b* out of the interior perimeter of the door or window opening, and pulling the barricade 10 out of said opening. Thus, the only physical modification to the building is the formation of the four receiving slots in the interior perimeter of a window or door opening to correspond with the two positioning bars 18 and the two perimeter locking ends 28*b*. As noted above, the invention can be made to comprise only a single positioning bar 18 and a locking bar 28 having only a single perimeter locking end 28*b*, in which case only two receiving slots need be formed in the window or door opening. In each case, the receiving slots in the window or door opening may comprise clean and smooth drilled apertures which would not stand out to a casual glance and thus would not constitute defacement of the structure.

There are thus preferably at least two receiving slots formed in the interior perimeter of a window or door opening, preferably formed in opposing sides thereof. However, such receiving slots may also be formed in adjacent sides of a window or door opening. It is also possible to eliminate the positioning bars 18 such that only one or two receiving slots are formed in only one side of a doorway or window opening for receiving perimeter locking ends 28*b* of a locking bar 28. This would require a very close fit of the barricade 10 into the window or door opening to be effective.

Figure 5:
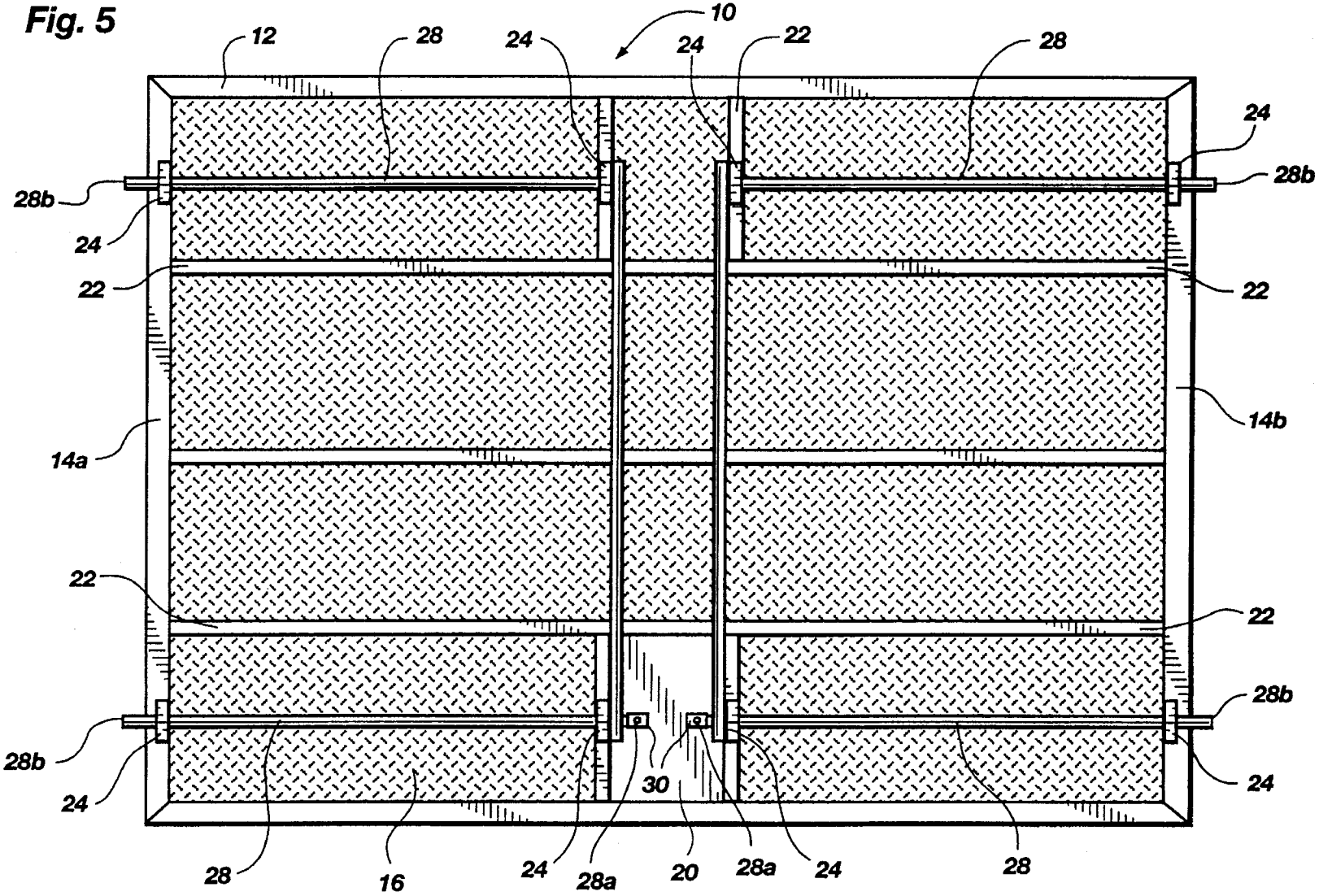
FIG. 5 is a front view of an alternative embodiment of the security barricade of FIG. 1.

An alternative embodiment of the barricade 10 is illustrated in FIG. 5. Instead of positioning bars as described above, this embodiment comprises two separate and preferably identical locking bars 28 made in the same manner as the single locking bar of FIG. 1 or its alternatives. The barricade 10 is placed within a window or door opening (not shown) and the locking bars 28 are slid into place so that the perimeter locking ends 28*b* are received within receiving slots formed in the interior perimeter of said window or door opening. There are thus two separate locking means 30 which are fabricated and operated in the manner of the locking means 30 described above (or its alternatives) in connection with FIGS. 1–2.

Figure 6:
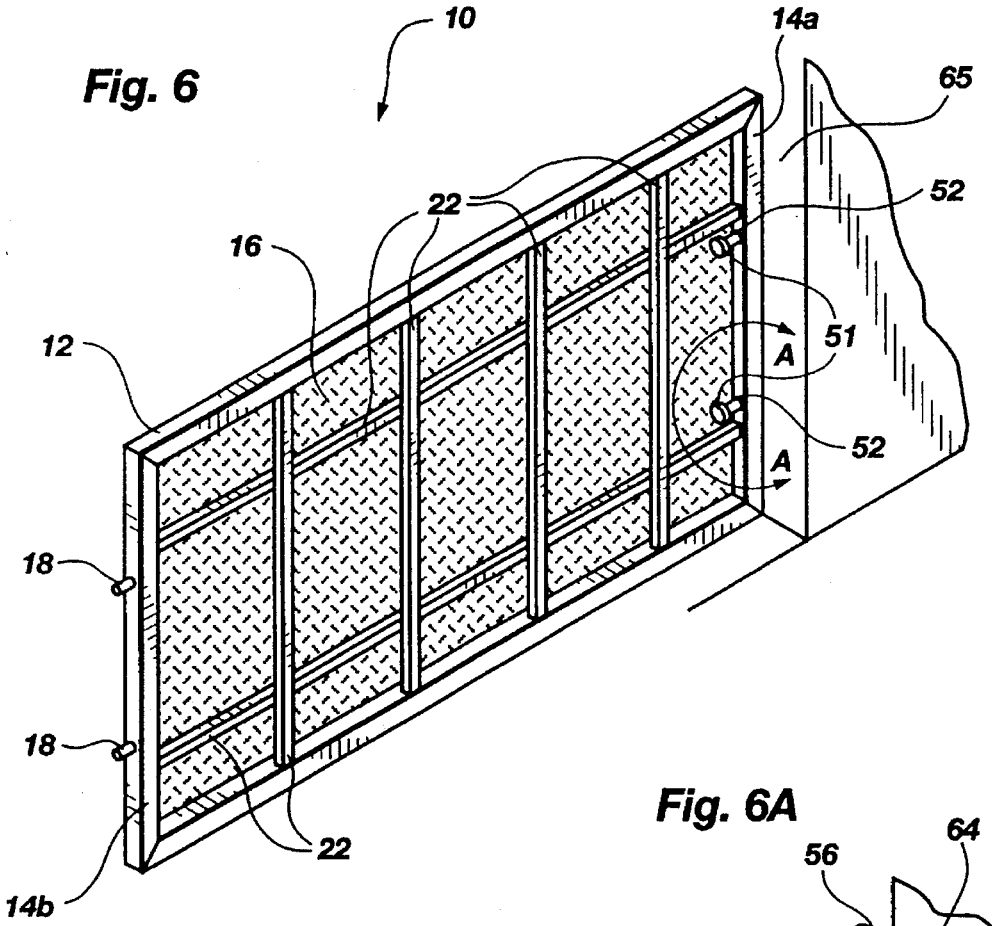
FIG. 6 is a perspective view of a preferred embodiment of the security barricade of FIG. 1.
Figure 6A:
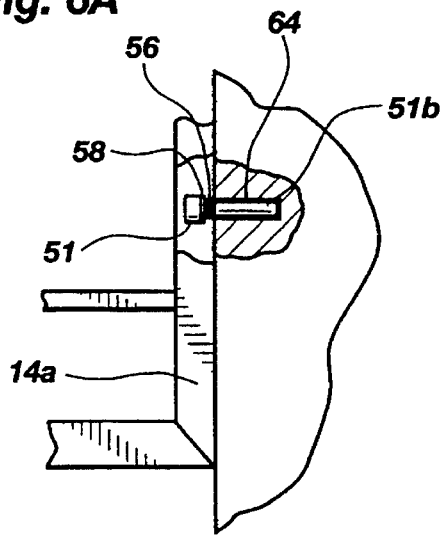
FIG. 6A is a cut-away view of FIG. 6 taken along section A—A.

An additional preferred embodiment of the barricade 10 is illustrated in FIGS. 6 and 6A. This embodiment includes positioning bars 18, but features no mounting plate or guide tabs. Instead, a locking bolt 51 is releasably screwed into a threaded slot 52 formed within the first frame member 14*a*. A perimeter locking end 51*b* of said bolt 51 is thereby secured within a receiving slot 64 formed in an interior perimeter 65 of a window or door opening. The receiving slot 64 is preferably, but not necessarily, unthreaded. The threaded slot 52 may alternatively comprise a threaded reinforcement insert 56 welded or,otherwise secured within the first frame member 14*a*, said insert 56 comprising a threaded opening.

Figure 7:
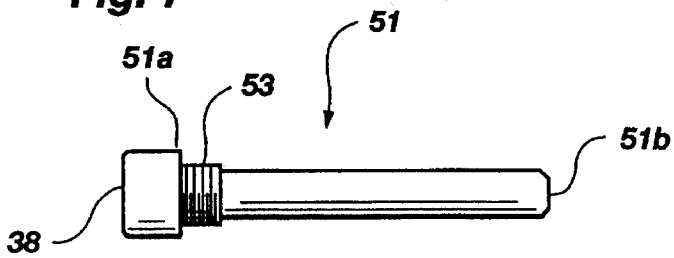
FIG. 7 is a side view of a preferred locking bolt for use with the present invention.

FIG. 7 illustrates a preferred embodiment of the locking bolt 51, which includes interior locking end 51*a* and perimeter locking end 51*b*. Said interior locking end 51*a* includes threads 53 and a customized slotted head 38 in the manner discussed previously in conjunction with FIG. 4. The perimeter locking end 51*b* is preferably, but not necessarily, unthreaded as shown in FIG. 7. A correspondingly mated wrench 40 as in FIG. 4 is used to screw/unscrew the locking bolt 51 into/out of the threaded slot 52 to thereby releasably secure the device 10 within the doorway or window opening 65 (FIG. 6). A locking washer 58 (FIG. 6A) as known in the art may be used with locking bolt 51.

The present invention represents a significant advance over traditional apparatus and methods of blocking window and door openings. It is noted that many of the advantages of the present invention accrue due to the locking means which is operable only with a corresponding customized locking wrench. The problems associated with building defacement, time consumption, strengths, reusability, portability and durability are overcome by the locking means and the relatively few connections required between the barricade and the window or door opening. Although the prior art apparatus and methods for blocking window and door openings provide some capacity for strength and durability, the present invention offers maximum strength and durability while solving all of the other problems noted above. Those skilled in the art will appreciate from the preceding disclosure that the objectives stated above are advantageously achieved by the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A security device for releasably blocking a doorway or window opening of a building structure, said device comprising:

a sturdy, continuous, metal frame configured to fit within an interior perimeter of the doorway or window opening, said frame defining an interior frame opening bounded on at least two opposing sides by first and second frame members which are substantially contiguous with sides of the doorway or window opening when in a secured position;

a security grid extending across and covering the interior frame opening and being anchored to the metal frame to form a single structure;

at least one positioning bar disposed on the second frame member and configured for placing into a receiving slot formed in the interior perimeter of the window or door opening; and a locking bar slidably disposed on the first frame member and having at least one perimeter locking end configured for slidable entry into a receiving slot formed in the interior perimeter of the window or door opening, wherein the locking bar comprises an elongate locking rod having at least one interior locking end;

means for releasbly restraining said locking bar from movement relative to the metal frame when said locking bar is seated within the receiving slot in the interior perimeter to retain said metal frame in a secure position;

at least one mounting plate coupled to the continuous metal frame and security grid and extending into the interior frame opening;

at least one first guide tab securely attached to the mounting plate and extending outward from the mounting plate, said at least one first guide tab including a guide track opening configured to slidably receive the locking rod;

at least one second guide tab securely attached to the first frame member and extending outward from the first frame member, said at least one second guide tab including a guide track opening configured to slidably receive the locking rod;

wherein the locking rod is slidably journalled within the at least one first and second guide tabs;

the means for releasably restraining comprising means for releasably interlocking the interior locking end of the locking rod with the at least one mounting plate when the locking rod is seated within the receiving slot in the interior perimeter to retain the metal frame in a secured position.

2. A security device as in claim 1 wherein the means for releasably interlocking comprise:

a threaded slot formed in the mounting plate for receiving a locking bolt;

the interior locking end of the locking rod, said interior locking end having an opening therein for positioning adjacently collinear with the receiving slot and for receiving a locking bolt; and a locking bolt placed within the opening of the interior locking end of the locking rod and configured for releasably screwing into the threaded slot formed in the mounting plate when said opening and said receiving slot are substantially adjacently collinear to thereby secure said locking bolt within said mounting plate.

3. A security device as in claim 2 wherein the threaded slot comprises a reinforcement insert secured within the mounting plate and having a threaded opening therein.

4. A security device as in claim 2 wherein the locking bolt includes a customized slotted head operable by a customized wrench mated to said customized slotted head.

5. A security device as in claim 1 wherein the security grid comprises a steel mesh cover.

6. A security device as in claim 5 wherein the security grid further comprises a gridwork of reinforcing ribs secured to the metal frame, said gridwork spanning said metal frame and secured to the steel mesh cover.

7. A security device as in claim 1 wherein the security grid comprises a gridwork of reinforcing ribs.

8. A security device as in claim 1 further comprising:

third and fourth guide tabs securely attached to the security grid and the first frame member, respectively, each guide tab having a guide track opening configured to slidably receive the locking rod, said locking rod comprising first and second spatially separate elongate rigid metal rods structurally connected by an elongate rigid metal member, said first rod slidably journalled within the first and second guide tabs and comprising said interior locking end, said second rod slidably journalled within the third and fourth guide tabs, each of said first and second rods having perimeter locking ends configured for slidable entry into separate receiving slots formed in the interior perimeter of the doorway or window opening.

9. A security device for releasably blocking a doorway or window opening of a building structure, said device comprising:

a sturdy, continuous, metal frame configured to fit within an interior perimeter of the doorway or window opening, said frame defining an interior frame opening bounded on at least two opposing sides by first and second frame members which are substantially contiguous with sides of the doorway or window opening when in a secured position;

a security grid extending across and covering the interior frame opening and being anchored to the metal frame to form a single structure;

at least one mounting plate coupled to the continuous metal frame and security grid and extending into the interior frame opening;

a first guide tab securely attached to the mounting plate and extending outward therefrom;

a second guide tab securely attached to the first frame member and extending outward therefrom;

a third guide tab securely attached to the mounting plate and extending outward therefrom;

a fourth guide tab securely attached to the second frame member and extending outward therefrom, each of said guide tabs including a guide track opening configured to slidably receive a locking bar; and first and second locking bars, the first locking bar journalled within the first and second guide tabs and the second locking bar journalled within the third and fourth guide tabs, said first and second locking bars having first and second perimeter locking ends add first and second interior locking ends, respectively, each of said perimeter locking ends configured for slidable entry into receiving slots formed in the interior perimeter of the window or door opening, said first and second interior locking ends respectively including first and second means for releasably interlocking with the at least one mounting plate when their respective locking bar is seated within a receiving slot in the interior perimeter to retain the metal frame in a secured position.

10. A security device as in claim 9 wherein the mounting plate further comprises first and second threaded slots formed therein, the first and second means for releasably interlocking respectively comprising:

the first and second interior locking ends of the first and second locking bars, said interior locking ends each having an opening therein for receiving a locking bolt; and first and second locking bolts placed within the first and second interior locking ends, respectively, of the first and second locking bars and configured for releasably screwing into the corresponding first and second threaded slots formed in the mounting plate to thereby secure said locking bolts against said mounting plate.

11. A security device as in claim 10 wherein the first and second locking bolts each include a customized slotted head operable by a customized wrench mated to said customized slotted head.

12. A security device as in claim 9 further comprising:

fifth and sixth guide tabs securely attached to the security grid;

seventh and eighth guide tabs securely attached to the first and second frame members, respectively, each of said fifth, sixth, seventh and eighth guide tabs having a guide track opening configured to slidably receive a locking bar, said first and second locking bars each comprising first and second spatially separate elongate rigid metal rods structurally connected by an elongate rigid metal member;

said first red of the first locking bar slidably journalled within the first and second guide tabs and comprising said first interior locking end, said second rod of the first locking bar slidably journalled within the fifth and seventh guide tabs, each of said first and second rods of the first locking bar having perimeter locking ends configured for slidable entry into separate receiving slots formed in the interior perimeter of the doorway or window opening;

said first rod of the second locking bar slidably journalled within the third and fourth guide tabs and comprising said second interior locking end, said second rod of the second locking bar slidably journalled within the sixth and eighth guide tabs, each of said first and second rods of the second locking bar having perimeter locking ends configured for slidable entry into separate receiving slots formed in the interior perimeter of the doorway or window opening.

13. A security device for releasably blocking a doorway or window opening of a building structure, said device comprising:

a sturdy, continuous, metal frame configured to fit within an interior perimeter of the doorway or window opening, said frame defining an interior frame opening bounded on at least two opposing sides by first and second frame members which are substantially contiguous with sides of the doorway or window opening when in a secured position;

a security grid extending across and covering the interior frame opening and being anchored to the metal frame to form a single structure;

at least one positioning bar disposed on the second frame member and configured for placing into a receiving slot formed in the interior perimeter of the window or door opening; and a locking bolt slidably disposed on the first frame member and having at least one perimeter locking end configured for slidable entry into a receiving slot formed in the interior perimeter of the window or door opening, wherein the locking bolt comprises a threaded interior locking end, and wherein the perimeter locking end of the locking bolt is unthreaded;

means for releasably restraining said locking bar from movement relative to the metal frame when said locking bar is seated within the receiving slot in the interior perimeter to retain said metal frame in a secured position, said means including a threaded slot formed in the first frame member and positioned adjacently collinear with the receiving slot of the interior perimeter of the window or door opening when the frame is placed therein, the locking bolt releasably screwable into said threaded slot such that the perimeter locking end of said bolt enters said receiving slot to thereby secure said locking bolt within the first frame member.

14. A security device as in claim 13 wherein the interior locking end of the locking bolt further comprises a customized slotted head operable by a customized wrench mated to said customized slotted head.

* * * * *